US007318378B2

(12) United States Patent
Bitterich et al.

(10) Patent No.: US 7,318,378 B2
(45) Date of Patent: Jan. 15, 2008

(54) TEMPERATURE CONTROL METHOD AND PRINTING MACHINE

(75) Inventors: Wolfgang Bitterich, Gemmingen (DE); Jürgen Rothaug, Nussloch (DE); Michael Schwandt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 277 days.

(21) Appl. No.: 11/183,578

(22) Filed: Jul. 18, 2005

(65) Prior Publication Data

US 2006/0011081 A1 Jan. 19, 2006

(30) Foreign Application Priority Data

Jul. 16, 2004 (DE) ..... 10 2004 034 385

(51) Int. Cl.
*B41F 23/04* (2006.01)

(52) U.S. Cl. ..... 101/147; 101/484; 101/487; 165/104.14; 165/104.19

(58) Field of Classification Search ..... 101/484, 101/487, 147, 148; 165/104.14, 104.19
See application file for complete search history.

(56) References Cited

U.S. PATENT DOCUMENTS 3,741,115 A * 6/1973 Keller ..... 101/148
5,272,971 A * 12/1993 Fredericks ..... 101/136
5,720,221 A * 2/1998 Harig et al. ..... 101/148
5,749,295 A * 5/1998 Kurz ..... 101/350.1
5,823,108 A * 10/1998 Kelm ..... 101/348
2002/0112636 A1* 8/2002 Desaulniers et al. ..... 101/487
2005/0074553 A1* 4/2005 Takahashi et al. ..... 427/240

FOREIGN PATENT DOCUMENTS

DE 40 00 912 C1 5/1991
DE 44 26 083 A1 1/1996
DE 195 02 475 A1 8/1996
EP 0 697 285 A2 8/1995

* cited by examiner

*Primary Examiner*—Daniel J. Colilla
*Assistant Examiner*—Kevin D. Williams
(74) *Attorney, Agent, or Firm*—Laurence A. Greenberg; Werner H. Stemer; Ralph E. Locher

(57) ABSTRACT

In a method for controlling the temperature of a first printing unit by way of a temperature control medium, the temperature control medium used is a dampening solution from a second printing unit.

15 Claims, 3 Drawing Sheets

TEMPERATURE CONTROL METHOD AND PRINTING MACHINE

BACKGROUND OF THE INVENTION

1. Field of the Invention

The present invention relates to a method for controlling the temperature of a printing unit by means of a temperature control medium.

In order to control the temperature of printing units or devices located therein, for example rolls, water is normally used.

It has become known, for example, from German patent DE 195 02 475 C2 (corresponding to U.S. Pat. No. 5,823,108) to use lubricant instead of water as a temperature control medium for the ductor roll of a printing unit.

2. Summary of the Invention

It is an object of the invention to provide a further temperature control method in a printing machine and also to provide a press that is suitable for the implementation of the novel method.

With the foregoing and other objects in view there is provided, in accordance with the invention, a method for controlling a temperature of a first printing unit, the method which comprises:

conducting dampening solution from a second printing unit; and utilizing the dampening solution from the second printing unit as a temperature control medium for controlling the temperature in the first printing unit.

In the method according to the invention, dampening solution which originates from another printing unit is used to control the temperature of the printing unit to be tempered. The dampening solution is therefore used multifunctionally; in one printing unit as a dampening solution per se and in the other printing unit as a temperature control medium. As a result, the construction of the press comprising the printing units is simplified. For example, the number of pumps needed is reduced. No additional temperature control medium pump is required and only one dampening solution pump is sufficient.

Various developments of the method according to the invention are possible, some will be explained briefly in the following text.

In one development, the printing unit in which the dampening solution is used as such and which, in the following text, will be designated the second printing unit, is a lithographic printing unit, that is to say a planographic printing unit. In this case, the other printing unit, which, in the following text, will be designated the first printing unit and in which the dampening solution is used as a temperature control medium, is not such a planographic printing unit. Accordingly, the two printing units are constructed differently from each other with respect to their printing process.

In a further development, the second printing unit is an offset printing unit and the first printing unit is a flexographic printing unit, for example used for spot varnishing.

In a further development, the first printing unit is a varnishing unit, for example used for full-surface varnishing.

According to a further development, by means of a temperature controller, temperatures of the dampening solution and temperature control medium which are different from the first printing unit to the second printing unit are set.

In this case, according to a further development, the dampening solution and temperature control medium can have its temperature controlled so as to be warmer in the first printing unit than in the second printing unit.

In a further development, the aforesaid temperature controller is an additional auxiliary temperature controller comprised by the press in addition to a central main temperature controller. The auxiliary temperature controller and the main temperature controller are incorporated in one and the same circuit of the dampening solution and temperature control medium.

Further developments contain different embodiments of the aforesaid auxiliary temperature controller. For example, the auxiliary temperature controller can have a mixing valve which branches off a partial quantity of the dampening solution and temperature control medium flowing back from the first printing unit in a return line and feeds this partial quantity into a feed line in which the dampening solution and temperature control medium flows to the first printing unit. Likewise, the auxiliary temperature controller can have a heat exchanger, via which the aforesaid return line is coupled thermally to the aforesaid feed line.

According to further developments, which can also be used in combination with one another, the temperature control of the first printing unit can be carried out in the following manner: the dampening solution and temperature control medium can be led through a roll and/or a trough belonging to the first printing unit. This roll can be, for example, an engraved roll or a dip roll. It is also possible to lead the dampening solution and temperature control medium to a heat exchanger, which couples a circuit for the printing ink processed in the first printing unit or the varnish processed therein thermally with that circuit in which the dampening solution and temperature control medium is circulated.

In a further development, the dampening solution is used as a coolant in the first printing unit. This is advantageous in particular when a solvent-based printing ink or a solvent-based varnish, such as a varnish emulsion with water as solvent, is printed in the first printing unit. Printing inks and varnishes of this type require cooling in many applications, in particular if they are pigmented printing inks or varnishes, metallures or iriodines.

The invention also includes a press which, on account of its construction, is suitable for the implementation of the method according to the invention or one of its developments.

Other features which are considered as characteristic for the invention are set forth in the appended claims.

Although the invention is illustrated and described herein as embodied in a temperature control method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
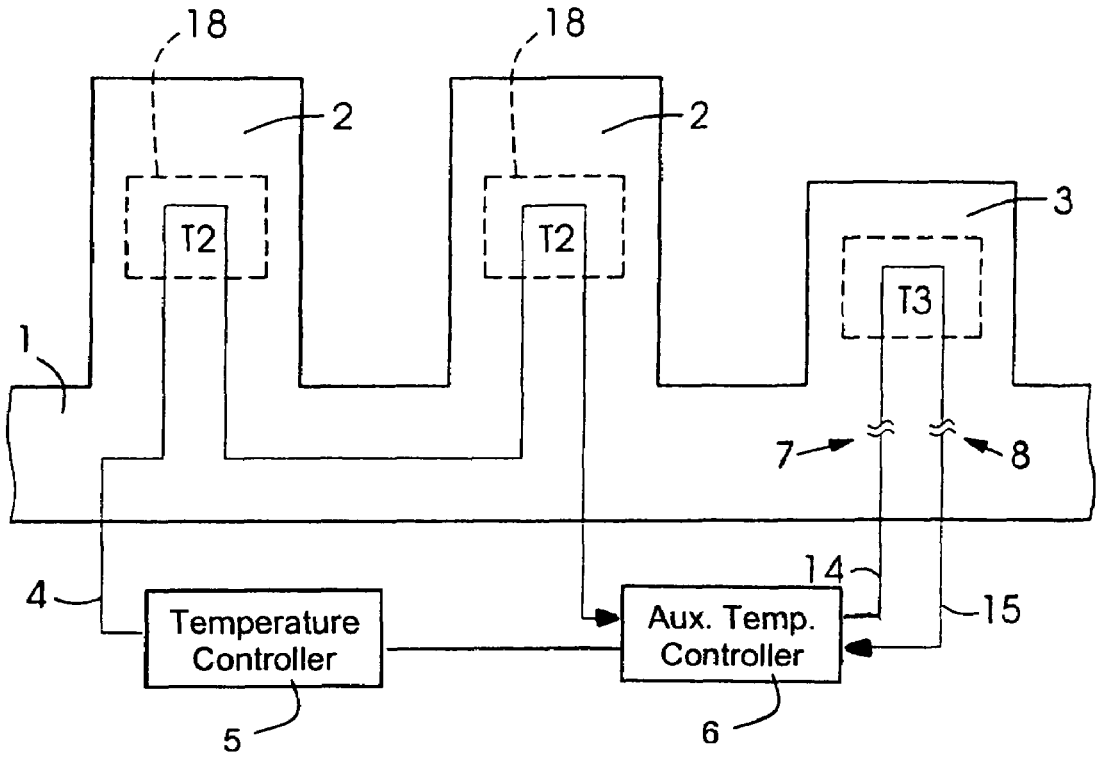
FIG. 1 is a diagram with the overall illustration of a dampening solution circuit.

Referring now to the drawing figures in detail and first, particularly, to FIG. 1 thereof, there is shown a press 1 having offset printing units 2 and a flexographic printing unit 3 in an in-line configuration. The offset printing units 2 in each case comprise a dampening unit 18, with which a dampening solution is applied to a printing form cylinder of the respective offset printing unit 2, in order on a planographic printing form of the printing form cylinder to keep its non-printing points free of the printing ink. The offset printing units 2 and the flexographic printing unit 3, which functions as a varnishing unit, are connected to each other via a dampening solution circuit 4. The dampening solution is pumped through the dampening solution circuit by means of a pump. The dampening solution consists of water and various additives, such as isopropanol. Constituent parts of the dampening solution circuit 4, apart from the dampening units 18, are also a main temperature controller 5, an auxiliary temperature controller 6, pipes, hoses and the like used to form a line system, and at least one of the objects to be cooled illustrated in FIGS. 2 to 4. The main temperature controller 5 ensures the dampening solution has a temperature $T_2$ during its processing in the offset printing units 2 and its dampening units 18. The auxiliary temperature controller 6 ensures that the dampening solution has a temperature $T_3$, which is lower than 20° C. and, for example, can be 12° C. to 14° C., during its processing in the flexographic printing unit 3 or the respective object to be cooled. $T_3 \neq T_2$ and $T_3 > T_2$.

The object to be cooled, illustrated highly schematically in FIG. 1, can be a roll 9 (cf. FIG. 2), a trough 10 (cf. FIG. 3) or a heat exchanger 11 (cf. FIG. 4), as is indicated by using imaginary interfaces 7, 8 of the line system.

Figure 2:
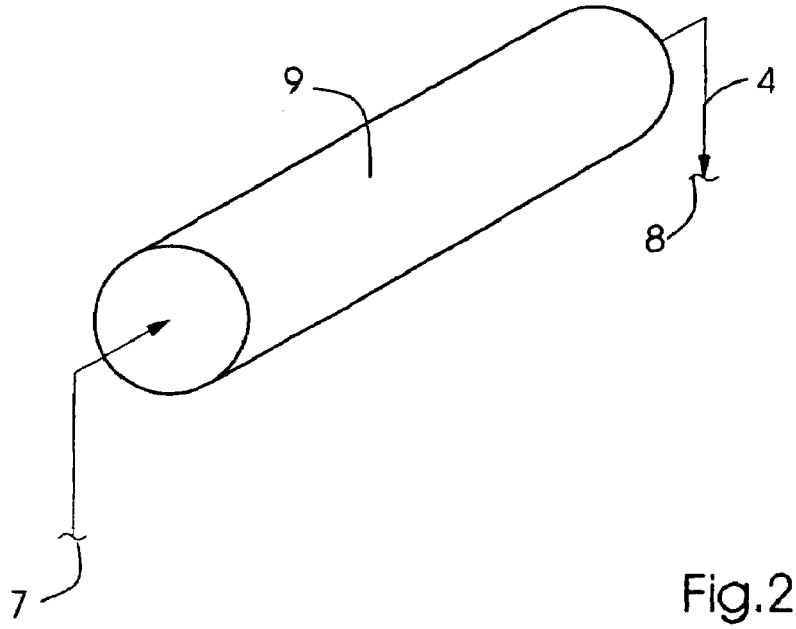
FIGS. 2-4 are simplified illustrations of various objects to be cooled that may be incorporated in the dampening solution circuit in order to cool them.

FIG. 2 shows that the dampening solution circuit 4 passes through the roll 9, which is hollow for this purpose. The circumferential surface of the roll 9 and the varnish or the printing ink on this circumferential surface has its temperature controlled to the temperature $T_3$, which is optimal in terms of processing.

Figure 3:
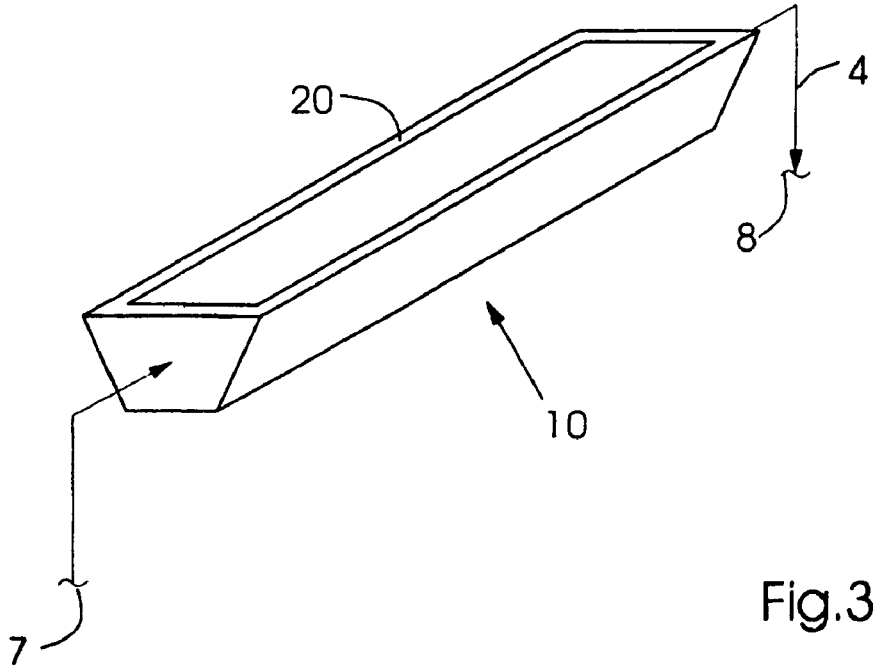

FIG. 3 shows that a trough or pan 10 is integrated into the dampening solution circuit 4. The trough 10 is used to store the varnish or printing ink and is equipped with a hollow wall 20, through which dampening solution flows. Via this hollow wall 20, the dampening solution cools the varnish or the printing ink down to the temperature $T_3$.

Figure 4:
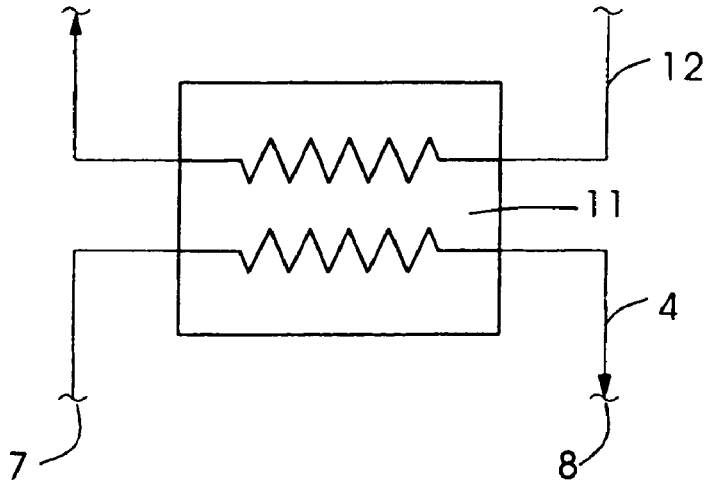

FIG. 4 shows that, within the heat exchanger 11, an ink or varnish circuit 12 and the dampening solution circuit 4 are connected to each other in such a way that a transfer of heat takes place from the ink or varnish circuit 12 to the dampening solution circuit 4, and the coating liquid (printing ink or varnish) pumped through the ink or varnish circuit 12 is kept at its temperature $T_3$ which is optimal for processing. A chamber-type doctor can be connected to the heat exchanger 11 via the ink or varnish circuit 12.

Of course, a plurality of objects to be cooled and illustrated in FIG. 2 to 4 can be integrated into the dampening solution circuit 4 in a parallel connection or a series connection.

Figure 5:
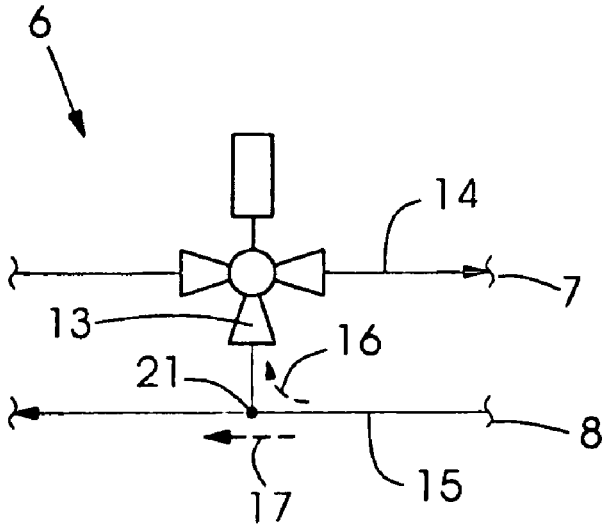
FIGS. 5 and 6 show various embodiments of an auxiliary temperature controller of the dampening solution circuit.

FIG. 5 shows a variant of the auxiliary temperature controller 6, the latter comprising a mixing valve 13 which is integrated into a feed line 14 through which the dampening solution flows to the object to be cooled. Of the total quantity of the dampening solution led away from this object to be cooled through a return line 15, a partial quantity 16 is branched off at the junction 21 and is mixed with the dampening solution in the feed line 14 via the mixing valve 13. The volume of the partial quantity 16 can be set and regulated at the mixing valve 13 on the basis of the temperature $T_3$ to be set on the object to be cooled. The temperature of the dampening solution in the return line 15 is higher than the temperature of the dampening solution in the feed line 14, since the dampening solution in the return line 15 has already taken up heat content during the cooling of the object to be cooled and the coating liquid. Accordingly, the temperature of the partial quantity 16 is also higher than the temperature of the dampening solution in the feed line 14 and permits the temperature $T_3$ to be controlled via the volume of the partial quantity 16 branched off. A remaining partial quantity 17 flows back from the node or junction 21 to the main temperature controller 5.

Figure 6:
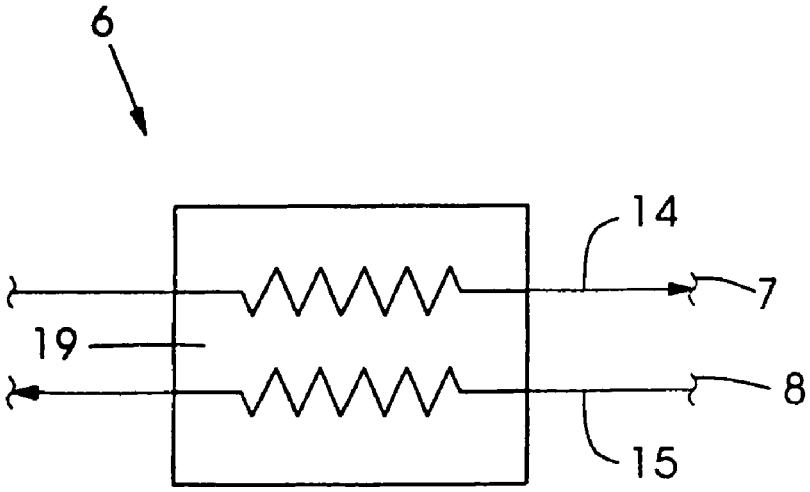

FIG. 6 shows a further variant of the auxiliary temperature controller 6, the latter comprising the heat exchanger 19 via which the feed line 14 and the return line 15 are coupled thermally to each other. The heat which the dampening solution in the return line 15 has picked up from the object to be cooled is partly transferred via the heat exchanger 19 to the dampening solution in the feed line 14, in order to heat the dampening solution exactly to the temperature $T_3$.

This application claims the priority, under 35 U.S.C. § 119, of German patent application No. 10 2004 034 385.3, filed Jul. 16, 2004; the entire disclosure of the prior application is herewith incorporated by reference.

We claim:

1. A method for controlling a temperature of a first printing unit being a non-lithographic printing unit, the method which comprises:

conducting dampening solution from a second printing unit being a lithographic printing unit; and utilizing the dampening solution from the second printing unit as a temperature control medium for controlling the temperature in the first printing unit.

2. The method according to claim 1, wherein the second printing unit is an offset printing unit and the first printing unit is a flexographic printing unit.

3. The method according to claim 1, wherein the first printing unit is a varnishing unit.

4. The method according to claim 1, which comprises setting, by way of a temperature controller, a first temperature of the dampening solution in the first printing unit to be different from a second temperature of the dampening solution in the second printing unit.

5. The method according to claim 4, wherein the first temperature is higher than the second temperature.

6. The method according to claim 4, wherein the temperature controller is an auxiliary temperature controller integrated into a dampening solution circuit in addition to a main temperature controller.

7. The method according to claim 6, wherein the auxiliary temperature controller has a mixing valve for mixing a partial quantity of the dampening solution from a return line of the first printing unit with the dampening solution in a feed line of the first printing unit.

8. The method according to claim 4, wherein the temperature controller has a mixing valve for mixing a partial quantity of the dampening solution from a return line of the first printing unit with the dampening solution in a feed line of the first printing unit.

9. The method according to claim 6, wherein the auxiliary temperature controller has a heat exchanger for thermally coupling a return line leading the dampening solution away from the first printing unit to a feed line leading the dampening solution to the first printing unit.

10. The method according to claim 4, wherein the temperature controller has a heat exchanger for thermally coupling a return line leading the dampening solution away from the first printing unit to a feed line leading the dampening solution to the first printing unit.

11. The method according to claim 1, which comprises conducting the dampening solution through a roll of the first printing unit.

12. The method according to claim 1, which comprises conducting the dampening solution through a trough of the first printing unit.

13. The method according to claim 1, which comprises conducting the dampening solution through a heat exchanger thermally coupling an ink or varnish circuit of the first printing unit to a dampening solution circuit.

14. The method according to claim 1, which comprises utilizing the dampening solution as a coolant in the first printing unit.

15. A method for controlling a temperature of a first printing unit, the method which comprises:

conducting dampening solution from a second printing unit;

utilizing the dampening solution from the second printing unit as a temperature control medium for controlling the temperature in the first printing unit; and setting, by way of a temperature controller, a first temperature of the dampening solution in the first printing unit to be different from a second temperature of the dampening solution in the second printing unit.

* * * * *